US009831615B2

(12) United States Patent
Saito et al.

(10) Patent No.: US 9,831,615 B2
(45) Date of Patent: Nov. 28, 2017

(54) CONNECTOR

(71) Applicants: Japan Aviation Electronics Industry, Limited, Tokyo (JP); JAE Europe Limited, Farnborough, Hampshire (GB)

(72) Inventors: Yuichi Saito, Tokyo (JP); Yuzo Sato, Farnborough (GB); Akihiro Matsunaga, Tokyo (JP); Masaaki Takaku, Tokyo (JP); Kouhei Ueda, Tokyo (JP); Yohei Yokoyama, Tokyo (JP)

(73) Assignees: Japan Aviation Electronics Industry, Limited, Tokyo (JP); Jae Europe Limited, Hampshire (GB)

( * ) Notice: Subject to any disclaimer, the term of this patent is extended or adjusted under 35 U.S.C. 154(b) by 0 days.

(21) Appl. No.: 15/487,064

(22) Filed: Apr. 13, 2017

(65) Prior Publication Data

US 2017/0222374 A1 Aug. 3, 2017

Related U.S. Application Data

(63) Continuation of application No. PCT/JP2015/071775, filed on Jul. 31, 2015.

(30) Foreign Application Priority Data

Nov. 20, 2014 (JP) ..... 2014-235336

(51) Int. Cl.
*H01R 13/6596* (2011.01)
*H01R 24/64* (2011.01)
(Continued)

(52) U.S. Cl.
CPC ..... *H01R 13/6596* (2013.01); *H01R 13/6581* (2013.01); *H01R 24/64* (2013.01); *H01R 2107/00* (2013.01)

(58) Field of Classification Search
CPC ..... H01R 13/6596
See application file for complete search history.

(56) References Cited

U.S. PATENT DOCUMENTS 9,331,433 B2 * 5/2016 Ueda ..... H01R 13/6581
9,437,980 B2 * 9/2016 Ueda ..... H01R 12/724
(Continued)

FOREIGN PATENT DOCUMENTS

CN 203871583 U 10/2014
JP 2013-041830 A 2/2013
(Continued)

*Primary Examiner* — James Harvey
(74) *Attorney, Agent, or Firm* — Muncy, Geissler, Olds & Lowe, P.C.

(57) ABSTRACT

A connector includes contacts arranged in a contact-arrangement plane and including a source contact and a signal contact, each of the contacts having a contact portion that comes into contact with a contact of a counter-connector, a ground plate made of metal disposed in parallel with the contact-arrangement plan, an insulator that holds the contacts and the ground plate, and a shell that covers an outer periphery of the insulator and is made of metal, the ground plate being disposed so as to face the contacts through a portion of the insulator with the contact portion of each contact being exposed, and having a cutout formed at an end of the ground plate adjacent to the contact portion of the source contact, and the insulator having a projection that fills the cutout of the ground plate.

9 Claims, 6 Drawing Sheets

(51) Int. Cl.
*H01R 13/6581* (2011.01)
*H01R 107/00* (2006.01)

(56) References Cited

U.S. PATENT DOCUMENTS

| | | | | |
|---|---|---|---|---|
| 9,728,885 | B2 * | 8/2017 | Yokoyama | H01R 13/502 |
| 2013/0045632 | A1 | 2/2013 | Lai | |
| 2016/0006198 | A1 * | 1/2016 | Ueda | H01R 13/405<br>439/607.01 |
| 2016/0064870 | A1 * | 3/2016 | Yu | H01R 24/60<br>439/607.05 |
| 2016/0322759 | A1 * | 11/2016 | Park | H01R 13/6585 |
| 2016/0365673 | A1 * | 12/2016 | Liang | H01R 12/57 |
| 2017/0222374 | A1 * | 8/2017 | Saito | H01R 13/6596<br>439/607.28 |

FOREIGN PATENT DOCUMENTS

| | | | |
|---|---|---|---|
| JP | 2014-041797 | A | 3/2014 |
| TW | M432963 | U1 | 7/2012 |
| WO | WO 2014-178209 | A1 | 11/2014 |

* cited by examiner

CONNECTOR

BACKGROUND OF THE INVENTION

The present invention relates to a connector, in particular, to a connector in which a shell covers an outer periphery of an insulator and a ground plate is disposed inside the shell.

Recently, electronic devices such as computers and mobile phones have been widely spread, and these electronic devices are normally equipped with connectors to be connected with outside devices to transmit electrical signals. As a connector of this type, one in which a measure against the electromagnetic interference (EMI) is taken by means of a metal shell covering an outer periphery of an insulator that holds a contact such that the transmitted electrical signals are prevented from being affected by electromagnetic waves from outside and that a peripheral electronic device is prevented from being affected by electromagnetic noise generated from the transmitted electrical signals is desirable.

For a connector having such a shell, a structure in which a metal ground plate is held by an insulator and disposed inside the shell so as to be adjacent to a contact, and when the connector is fitted with a counter-connector, a ground terminal of the counter-connector is connected to the ground plate has been attempted.

For instance, the specification of the Chinese Utility Model publication No. 203871583 discloses a connector in which a plurality of contacts 1 are arranged and held by an insulator 2, while a ground plate 3 is attached to the insulator 2 to be adjacent to the plurality of contacts 1 with a contact point 1A of each of the contacts 1 being exposed, and a shell 4 covers an outer periphery of the plurality of contacts 1, the insulator 2 and the ground plate 3, as illustrated in FIG. 17.

Since the connector includes the ground plate 3, influence of electromagnetic waves can be further suppressed.

Meanwhile, there is a problem that the ground plate 3 and the contacts 1 are easily short-circuited since the contacts 1 and the ground plate 3 are close to each other.

In particular, if the ground plate 3 and a source contact for power supply among the plurality of contacts 1 are electrically short-circuited, an electric potential so largely varies that an electric circuit connected to the connector may be damaged.

SUMMARY OF THE INVENTION

The present invention has been made to solve the conventional problem and is aimed at providing a connector that can prevent electric short-circuits between a source contact and a ground plate and has the increased reliability.

The inventors of the present invention have conducted an intense study and discovered that since a contact portion is exposed, a foreign object such as abrasion powder of a contact of a counter-connector, for example, adheres to the exposed contact portion of the contact, and the foreign object is affected by moisture in the atmosphere to form a fine electric path between the contact portion of the contact and the ground plate, which causes an electric short-circuit between the contact and ground plate.

Accordingly, even if an insulator is disposed between the contact and the ground plate so that the position of the ground plate is slightly separated from the surface of the contact in a perpendicular direction within a limited space inside a shell, an electric path is likely to be formed between the contact and the ground plate due to a foreign object adhering to the contact portion of the contact, and hence occurrence of an electric short-circuit cannot be sufficiently prevented.

A connector according to the present invention comprises:

a plurality of contacts arranged in a contact-arrangement plane and including a source contact and a signal contact, each of the plurality of contacts having a contact portion that comes into contact with a contact of a counter-connector;

a ground plate made of metal disposed in parallel with the contact-arrangement plane;

an insulator that holds the plurality of contacts and the ground plate; and a shell that covers an outer periphery of the insulator and is made of metal, wherein the ground plate is disposed so as to face the plurality of contacts through a portion of the insulator with the contact portion of each of the plurality of contacts being exposed, and has a cutout formed at an end of the ground plate adjacent to the contact portion of the source contact, and wherein the insulator has a projection that fills the cutout of the ground plate.

DETAILED DESCRIPTION OF THE INVENTION

Figure 1A:
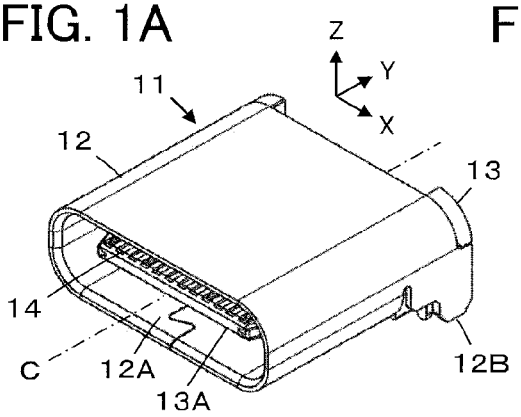
FIGS. 1A to 1G are a perspective view when viewed obliquely from front, a perspective view when viewed obliquely from rear, a plan view, a bottom view, a front view, a rear view and a side view, respectively, illustrating a connector according to Embodiment 1 of the present invention.
Figure 1B:
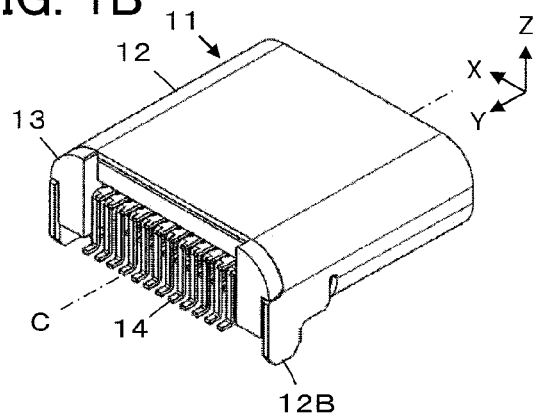
Figure 1C:
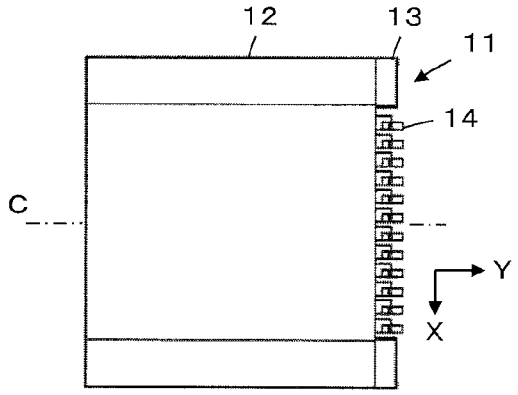
Figure 1D:
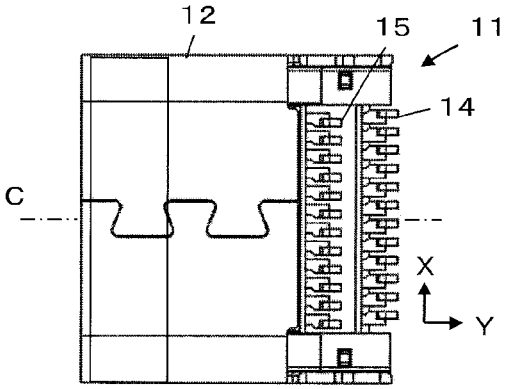
Figure 1E:
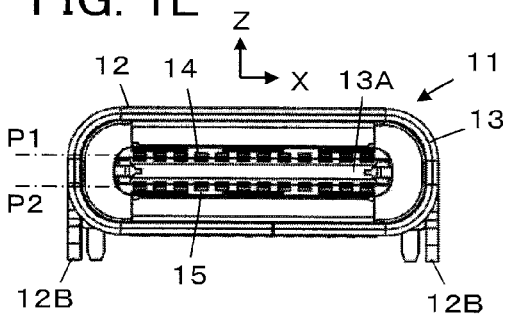
Figure 1F:
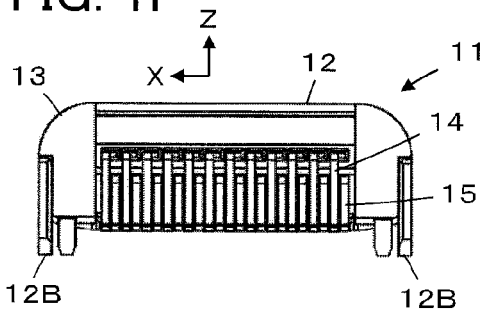
Figure 1G:
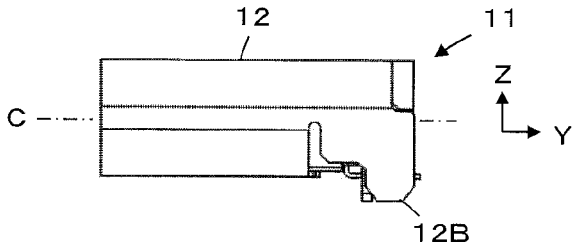

An embodiment of the present invention is described below based on the appended drawings.

Embodiment 1

FIGS. 1A to 1G show a connector 11 according to Embodiment 1. The connector 11 is a receptacle connector fixed to a board in an electronic device such as a mobile device or an information appliance and has a peripheral shell 12 made of metal. The peripheral shell 12 has an insulator 13 therein and the insulator 13 holds a plurality of first contacts 14 and a plurality of second contacts 15.

The peripheral shell 12 covers an outer periphery of the insulator 13 except a front face part and a back face part of the insulator 13 in a direction of a fitting axis C of the connector 11, forming thereinside a counter-connector accommodation portion 12A into which a counter-connector is inserted. The peripheral shell 12 is provided with a plurality of shell leg portions 12B that project in a direction perpendicular to the fitting axis C of the connector 11 and are used for mounting of the connector 11 on the board of an electronic device or the like (not shown).

The insulator 13 includes a tongue-like portion 13A in a flat plate shape extending along the fitting axis C inside the peripheral shell 12, and the plurality of first contacts 14 and the plurality of second contacts 15 are respectively arranged on both sides of the tongue-like portion 13A in the direction perpendicular to the fitting axis C.

For convenience, a direction from front to back of the connector along the fitting axis C is called "Y direction," an arrangement direction of the first contacts 14 and second contacts 15 "X direction," and a direction perpendicular to an XY plane and extending from the second contacts 15 to the first contacts 14 "Z direction."

The plurality of first contacts 14 are arranged in a first contact-arrangement plane P1 along an XY plane, while the plurality of second contacts 15 are arranged in a second contact-arrangement plane P2 along the XY plane.

Figure 2:
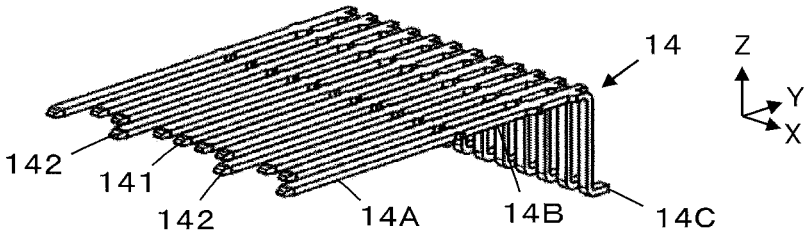
FIG. 2 is a perspective view showing a plurality of first contacts used in the connector according to Embodiment 1.

As illustrated in FIG. 2, each of the first contacts 14 has a contact portion 14A extending in the Y direction, a fixing portion 14B connected to an end in the +Y direction of the contact portion 14A, and a board-connecting portion 14C bending from an end in the +Y direction of the fixing portion 14B to the −Z direction. The first contacts 14 include a plurality of first signal contacts 141 for transmitting and receiving signals to and from the counter-connector and two first source contacts 142 for power supply in addition to other contacts such as a ground contact and a contact for detecting fitting of the connectors. The first contacts 14 are respectively pressed into a plurality of through-holes formed in the insulator 13 in parallel with the fitting axis C, thereby being held by the insulator 13.

Figure 3:
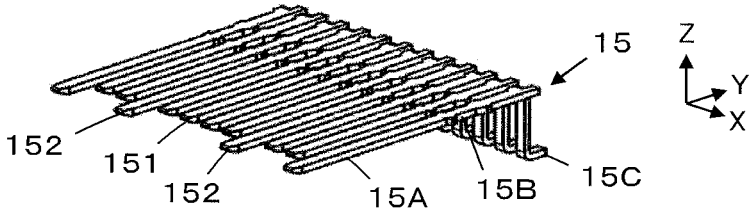
FIG. 3 is a perspective view showing a plurality of second contacts used in the connector according to Embodiment 1.

Similarly, as illustrated in FIG. 3, each of the second contacts 15 has a contact portion 15A extending in the Y direction, a fixing portion 15B connected to an end in the +Y direction of the contact portion 15A, and a board-connecting portion 15C bending from an end in the +Y direction of the fixing portion 15B to the −Z direction. The second contacts 15 are disposed symmetrically to the first contacts 14 about the fitting axis C and include a plurality of second signal contacts 151 for transmitting and receiving signals to and from the counter-connector and two second source contacts 152 for power supply in addition to other contacts such as a ground contact and a contact for detecting fitting of the connectors. The second contacts 15 are respectively pressed into a plurality of through-holes formed in the insulator 13 in parallel with the fitting axis C, thereby being held by the insulator 13.

The two first source contacts 142 and the two second source contacts 152 are disposed so as to be overlapped on each other in the Z direction.

Figure 4:
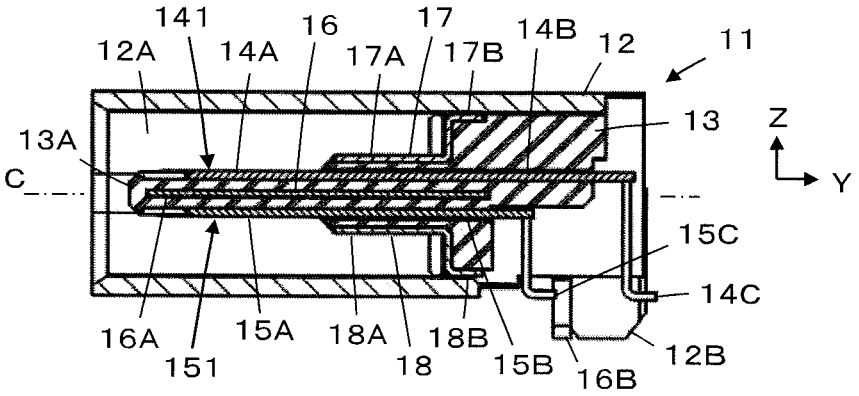
FIG. 4 is a cross-sectional side view of the connector according to Embodiment 1 cut through a first signal contact and a second signal contact.

FIG. 4 shows a cross-sectional view of the connector 11 as cut in a YZ plane passing through one first signal contact 141 and one second signal contact 151.

Of the first signal contact 141, the contact portion 14A is exposed to the counter-connector accommodation portion 12A of the peripheral shell 12, the fixing portion 14B is embedded in and fixed by the insulator 13, and the board-connecting portion 14C protrudes from the back part of the insulator 13. Similarly, of the second signal contact 151, the contact portion 15A is exposed to the counter-connector accommodation portion 12A of the peripheral shell 12, the fixing portion 15B is embedded in and fixed by the insulator 13, and the board-connecting portion 15C protrudes from the back part of the insulator 13.

The contact portions 14A and 15A come into contact with a signal contact of the counter-connector (not shown) that is inserted in the counter-connector accommodation portion 12A, while the board-connecting portions 14C and 15C are connected to connection pads on the board of an electronic device or the like (not shown).

The tongue-like portion 13A of the insulator 13 has thereinside a metal mid-plate 16 extending along the XY plane. The mid-plate 16 includes a mid-plate body 16A that is embedded in the insulator 13 and mid-plate leg portions 16B each bending from an end in the +Y direction of the mid-plate body 16A to the −Z direction and exposed from the insulator 13.

In addition, a first ground plate 17 made of metal is disposed on the +Z direction side of the fixing portion 14B of the first signal contact 141. The first ground plate 17 includes a ground plate body 17A in a flat plate shape facing the +Z direction side of the fixing portions 14B of all of the first contacts 14 via the insulator 13, which first contacts 14 are arranged in the X direction, and a shell-connecting portion 17B bending from an end in the +Y direction of the ground plate body 17A to the +Z direction and connected to an inside surface of the peripheral shell 12. A surface facing in the +Z direction of the ground plate body 17A is exposed to the counter-connector accommodation portion 12A of the peripheral shell 12 and, when the connector 11 is fitted with the counter-connector, comes into contact with a grounding spring contact of the counter-connector.

Similarly, a second ground plate 18 made of metal is disposed on the −Z direction side of the fixing portion 15B of the second signal contact 151. The second ground plate 18 includes a ground plate body 18A in a flat plate shape facing the −Z direction side of the fixing portions 15B of all of the second contacts 15 via the insulator 13, which second contacts 15 are arranged in the X direction, and a shell-connecting portion 18B bending from an end in the +Y direction of the ground plate body 18A to the −Z direction and connected to an inside surface of the peripheral shell 12. A surface facing in the −Z direction of the ground plate body 18A is exposed to the counter-connector accommodation portion 12A of the peripheral shell 12 and, when the connector 11 is fitted with the counter-connector, comes into contact with a grounding spring contact of the counter-connector.

Figure 5:
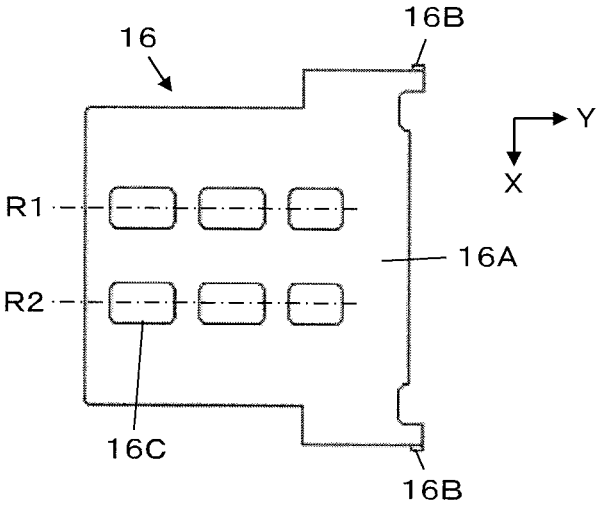
FIG. 5 is a plan view showing a mid-plate used in the connector according to Embodiment 1.

As illustrated in FIG. 5, the mid-plate body 16A of the mid-plate 16 is provided with a plurality of opening portions 16C arranged in two rows R1 and R2 in parallel with each other and extending in the Y direction. The two rows R1 and R2 correspond to the locations of the two first source contacts 142 and the two second source contacts 152.

Figure 6:
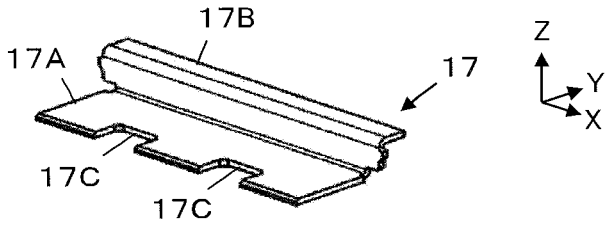
FIG. 6 is a perspective view showing a first ground plate used in the connector of Embodiment 1.

As illustrated in FIG. 6, the ground plate body 17A of the first ground plate 17 is provided with two cutouts 17C at its end in the −Y direction at locations corresponding to the two first source contacts 142. In other words, each of the cutouts 17C is formed at the end of the first ground plate 17 adjacent to the contact portion 14A of the first source contact 142.

Figure 7:
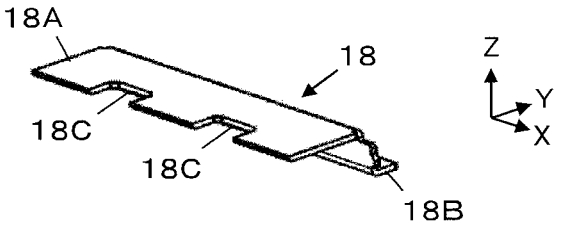
FIG. 7 is a perspective view showing a second ground plate used in the connector of Embodiment 1.

Similarly, as illustrated in FIG. 7, the ground plate body 18A of the second ground plate 18 is provided with two cutouts 18C at its end in the −Y direction at locations corresponding to the two second source contacts 152. In other words, each of the cutouts 18C is formed at the end of the second ground plate 18 adjacent to the contact portion 15A of the second source contact 152.

Figure 8:
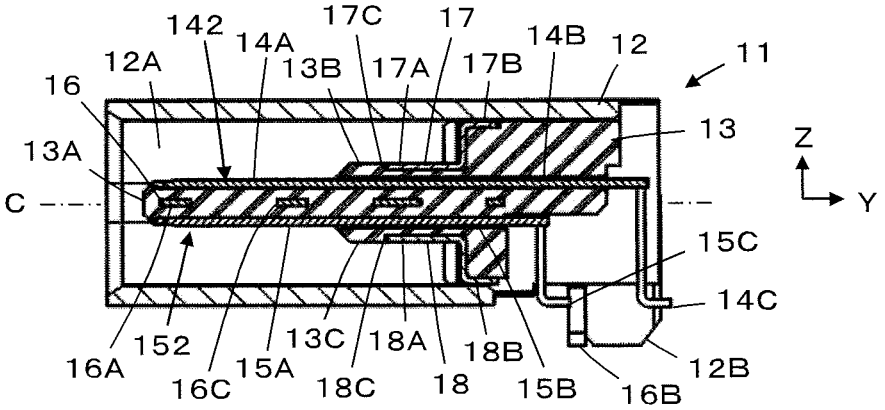
FIG. 8 is a cross-sectional side view of the connector according to Embodiment 1 cut through a first source contact and a second source contact.

FIG. 8 shows a cross-sectional view of the connector 11 as cut in the YZ plane passing through one first source contact 142 and one second source contact 152.

The plurality of opening portions 16C formed in the mid-plate body 16A of the mid-plate 16 face the first source contacts 142 and the second source contacts 152 and are filled with the insulator 13.

The insulator 13 exists between the fixing portion 14B of the first source contact 142 and the ground plate body 17A of the first ground plate 17, the cutout 17C is formed at the end in the −Y direction of the ground plate body 17A at a location corresponding to the fixing portion 14B adjacent to the contact portion 14A of the first source contact 142, and a projection 13B that is formed on the insulator 13 and projects in the +Z direction is inserted into the cutout 17C such that the cutout 17C is filled with the projection 13B of the insulator 13.

Similarly, the insulator 13 exists between the fixing portion 15B of the second source contact 152 and the ground plate body 18A of the second ground plate 18, the cutout 18C is formed at the end in the −Y direction of the ground plate body 18A at a location corresponding to the fixing portion 15B adjacent to the contact portion 15A of the second source contact 152, and a projection 13C that is formed on the insulator 13 and projects in the −Z direction is inserted into the cutout 18C such that the cutout 18C is filled with the projection 13C of the insulator 13.

Figure 9:
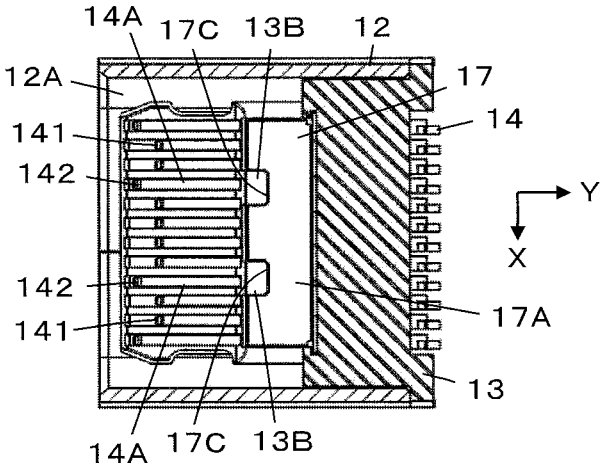
FIG. 9 is a cross-sectional plan view of the connector of Embodiment 1.

As illustrated in FIG. 9, since the cutout 17C is formed in the ground plate body 17A of the first ground plate 17, the end of the first ground plate 17 in the −Y direction is distant from the contact portion 14A of the first source contact 142 that is exposed to the counter-connector accommodation portion 12A of the peripheral shell 12, while the projection 13B of the insulator 13 is disposed between the end of the first ground plate 17 in the −Y direction and the contact portion 14A of the first source contact 142.

Figure 10:
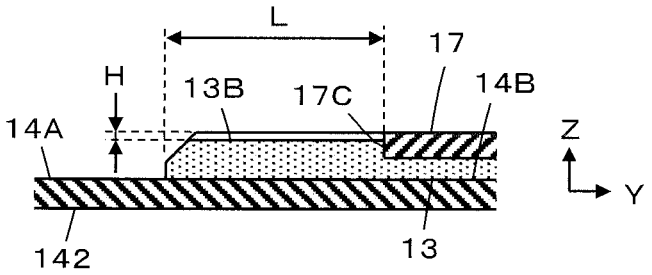
FIG. 10 is a cross-sectional side view showing the first source contact and the first ground plate in the connector of Embodiment 1.

In other words, as illustrated in FIG. 10, not only the insulator 13 exists between the first ground plate 17 and the fixing portion 14B of the first source contact 142 but also the end of the first ground plate 17 in the −Y direction is separated from the contact portion 14A of the first source contact 142 by a predetermined distance L. Hence, even if a foreign object like abrasion powder that is generated due to abrasion with the contact of the counter-connector adheres to the contact portion 14A of the first source contact 142 and is affected by moisture in the atmosphere, it is unlikely that an electric path from the contact portion 14A of the first source contact 142 reaching to the first ground plate 17 over the predetermined distance L would be formed, whereby an occurrence of an electric short-circuit between the first source contact 142 and the first ground plate 17 can be effectively prevented.

Moreover, since the cutout 17C formed at an end of the first ground plate 17 adjacent to the contact portion 14A of the first source contact 142 is filled with the projection 13B of the insulator 13, a distance between the contact portion 14A of the first source contact 142 and the end of the first ground plate 17 in the −Y direction can be further increased while accumulation of foreign objects such as abrasion powder in the cutout 17C can be prevented, whereby an occurrence of an electric short circuit between the first source contact 142 and the first ground plate 17 can be more effectively prevented.

The projection 13B of the insulator 13 with which the cutout 17C of the first ground plate 17 is filled is configured to have its surface positioned lower than a surface of the first ground plate 17 near the cutout 17C and closer to the first source contact 142 by a small height H such that the projection 13B does not protrude above the surface of the first ground plate 17. The reason therefor is because, when the connector 11 is fitted with the counter-connector, the grounding spring contact of the counter-connector is not prevented from contacting the surface of the ground plate body 17A of the first ground plate 17 that is exposed to the counter-connector accommodation portion 12A of the peripheral shell 12.

Figure 11:
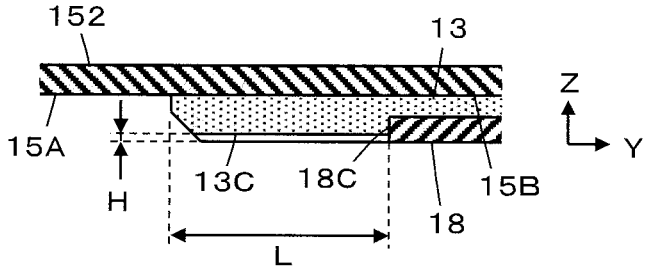
FIG. 11 is a cross-sectional side view showing the second source contact and the second ground plate in the connector of Embodiment 1.

The second ground plate 18 also has a similar configuration to that of the first ground plate 17 such that, as illustrated in FIG. 11, not only the insulator 13 exists between the second ground plate 18 and the fixing portion 15B of the second source contact 152 but also an end of the second ground plate 18 in the −Y direction is separated from the contact portion 15A of the second source contact 152 by the predetermined distance L. Hence, even if a foreign object like abrasion powder adheres to the contact portion 15A of the second source contact 152 and is affected by moisture in the atmosphere, it is unlikely that an electric path from the contact portion 15A of the second source contact 152 reaching to the second ground plate 18 over the predetermined distance L would be formed, whereby an occurrence of an electric short circuit between the second source contact 152 and the second ground plate 18 can be effectively prevented.

Moreover, since the cutout 18C formed at an end of the second ground plate 18 adjacent to the contact portion 15A of the second source contact 152 is filled with the projection 13C of the insulator 13, a distance between the contact portion 15A of the second source contact 152 and the end of the second ground plate 18 in the −Y direction can be further increased while accumulation of foreign objects such as abrasion powder in the cutout 18C can be prevented, whereby an occurrence of an electric short circuit between the second source contact 152 and the second ground plate 18 can be more effectively prevented.

The projection 13C of the insulator 13 with which the cutout 18C of the second ground plate 18 is filled is configured to have its surface closer to the second source contact 152 than a surface of the second ground plate 18 near the cutout 18C by the small height H such that the projection 13C does not protrude above the surface of the second ground plate 18.

Figure 12:
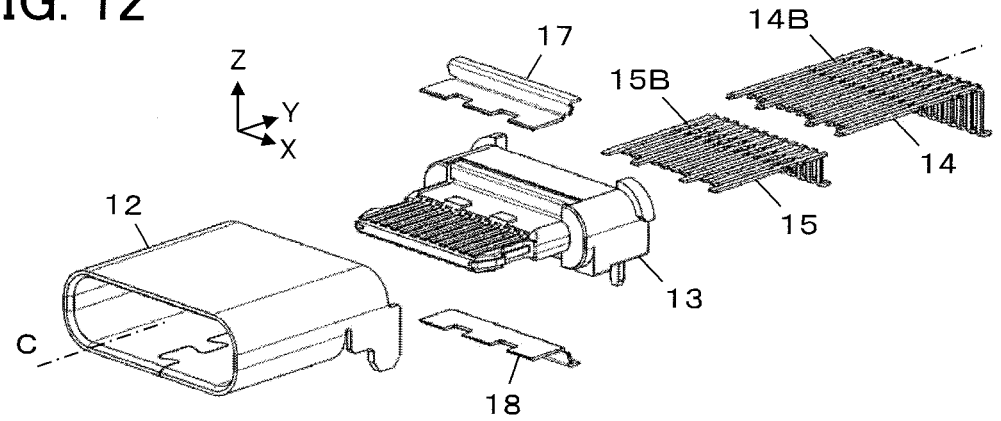
FIG. 12 is an exploded perspective view of the connector of Embodiment 1.

As illustrated in FIG. 12, the connector 11 can be manufactured by the steps of molding the insulator 13 integrally with the mid-plate 16 such that the plurality of through-holes corresponding to the plurality of first contacts 14 and the plurality of second contacts 15 are formed therein, then pressing and fixing the fixing portions 14B of the first contacts 14 and the fixing portion 15B of the second contacts 15 into the through-holes in the insulator 13, attaching the first ground plate 17 and the second ground plate 18 to the insulator 13, and pressing the resultant into the interior of the peripheral shell 12.

The connector 11 is used with the board-connecting portions 14C of the first contacts 14 and the board-connecting portions 15C of the second contacts 15 as well as the shell leg portions 12B of the peripheral shell 12 and the mid-plate leg portions 16B of the mid-plate 16 being connected to the corresponding connection pads on the board in an electronic device (not shown) by soldering or the like.

Since the shell-connecting portion 17B of the first ground plate 17 and the shell-connecting portion 18B of the second ground plate 18 are connected to the inside surface of the peripheral shell 12, when the shell leg portions 12B of the peripheral shell 12 and the mid-plate leg portions 16B of the mid-plate 16 are connected to the corresponding connection pads on the board in an electronic device (not shown) and brought to ground potential, the mid-plate 16, the first ground plate 17, the second ground plate 18 and the peripheral shell 12 are to be all at ground potential accordingly, which makes it possible to reduce the influence of electromagnetic waves to carry out highly accurate signal transmission.

As described above, since the first ground plate 17 is provided with the cutouts 17C at the end thereof adjacent to the contact portions 14A of the first source contacts 142 while the cutouts 17C are filled with the projections 13B of the insulator 13, and the second ground plate 18 is provided with the cutouts 18C at the end thereof adjacent to the contact portions 15A of the second source contacts 152 while the cutouts 18C are filled with the projections 13C of the insulator 13, an electric short circuit between the first ground plate 17 and the first source contacts 142 or between the second ground plate 18 and the second source contacts 152 can be prevented and reliability of the connector 11 can be improved.

In addition, the mid-plate body 16A of the mid-plate 16 is provided with the plurality of opening portions 16C corresponding to the first source contacts 142 and the second source contacts 152. Hence, in the connector 11 configured such that the first signal contacts 141 include three pairs of differential signal contacts, two of which pairs are each disposed on both sides of each of the two first source contacts 142 and one of which pairs is disposed between the two first source contacts 142, and that the second signal contacts 151 include three pairs of differential signal contacts, two of which pairs are each disposed on both sides of each of the two second source contacts 152 and one of which pairs is disposed between the two second source contacts 152, occurrence of crosstalk between a pair of differential signal contacts and another pair of differential signal contacts via the mid-plate 16 can be prevented. As a result, high-speed and highly accurate transmission of signals becomes possible.

While in the foregoing Embodiment 1, the first contacts 14 and the second contacts 15 are arranged in two rows facing each other via the mid-plate 16, the invention is not limited thereto and may be applied to a connector in which a plurality of contacts are arranged in a single row.

The number of contacts is not limited, and it suffices if one or more contacts are held by a housing.

Embodiment 2

Figure 13:
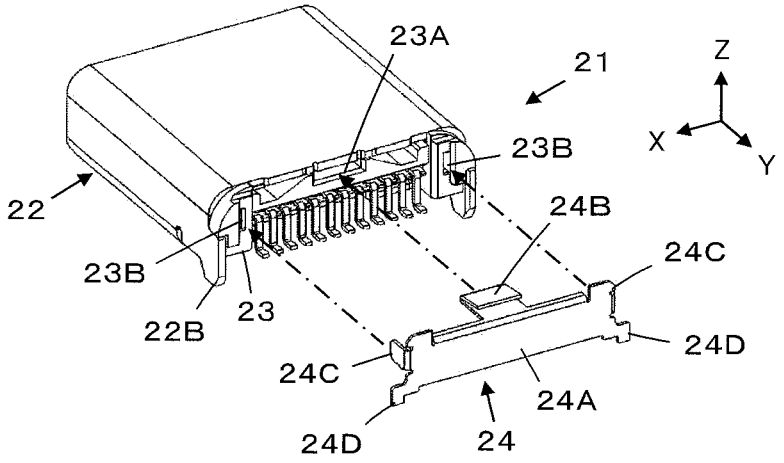
FIG. 13 is a perspective view showing how a back shell is attached to an insulator of a connector according to Embodiment 2.

FIG. 13 illustrates the structure of a connector 21 according to Embodiment 2.

The connector 21 is identical to the connector 11 of Embodiment 1 and has same constituent components as those of the connector 11, except having a peripheral shell 22 covering an outer periphery of an insulator 23 and a back shell 24 covering a back face part of the insulator 23, in place of the peripheral shell 12 covering the outer periphery of the insulator 13.

The peripheral shell 22 has the same configuration as that of the peripheral shell 12 used in the connector 11 of Embodiment 1 and includes a plurality of shell leg portions 22B for being mounted on a board in an electronic device or the like (not shown).

Meanwhile, the back shell 24 has a back shell body 24A in a substantially-rectangular plate shape that covers the back face part of the insulator 23, and the back shell body 24A is provided with a spring contact portion 24B that projects from an edge, in the +Z direction, of the back shell body 24A in the −Y direction perpendicular to the back shell body 24A. In addition, claw portions 24C each in a substantially-rectangular shape are formed at opposite ends of the back shell body 24A in the X direction and project in the −Y direction, serving as held portions to be held by the insulator 23. Moreover, butt-joint terminals 24D are formed at lower parts of opposite ends of the back shell body 24A in the X direction and project in the −Z direction.

The insulator 23 is provided at an edge of a back face thereof in the +Z direction with a step portion 23A and at opposite ends of the back face thereof in the X direction with claw portion-insertion holes 23B serving as back shell holders.

The spring contact portion 24B of the back shell 24 is inserted into a space formed between the step portion 23A of the insulator 23 and an inside surface of the peripheral shell 22 at an end thereof in the +Y direction while a pair of the claw portions 24C of the back shell 24 are pressed into the corresponding claw portion-insertion holes 23B of the insulator 23, whereby the back shell 24 is held and fixed at the back face part of the insulator 23. At the same time, the spring contact portion 24B of the back shell 24 comes into contact with the inside surface of the peripheral shell 22 at the end thereof in the +Y direction so that the peripheral shell 22 is electrically connected to the back shell 24.

Figure 14:
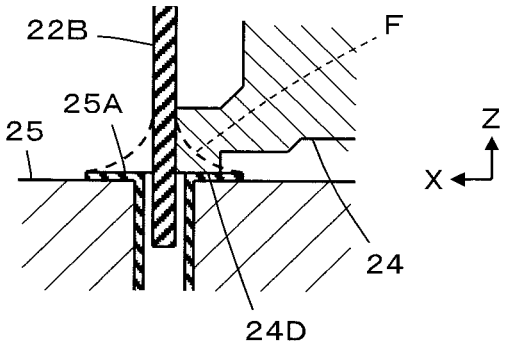
FIG. 14 is a cross-sectional view showing a leg portion of a peripheral shell and a butt-joint terminal of the back shell in the connector of Embodiment 2.

The connector 21 is used as being mounted on a board 25 as illustrated in FIG. 14, and each of the shell leg portions 22B of the peripheral shell 22 is inserted into a through-hole 25A formed in the board 25 and fixed by means of soldering, whereby the peripheral shell 22 is mounted and fixed on the board 25. In this process, each of the butt-joint terminals 24D of the back shell 24 is located adjacent to the corresponding shell leg portion 22B of the peripheral shell 22, and when each of the shell leg portions 22B of the peripheral shell 22 is soldered at the corresponding through-hole 25A in the board 25, a solder fillet F is formed and fixes the butt-joint terminal 24D to a pad at the through-hole 25A on the board surface side.

That is, through the process of soldering the shell leg portions 22B of the peripheral shell 22 at their corresponding through-holes 25A of the board 25, the butt-joint terminals 24D of the back shell 24 can be connected to the corresponding through-holes 25A of the board 25 at the same time as the mounting of the peripheral shell 22 on the board 25. Accordingly, the peripheral shell 22 and the back shell 24 are connected at ground potential via the through-holes 25A of the board 25.

Since the peripheral shell 22 covers the outer periphery of the insulator 23 except the front face part and the back face part thereof while the back shell 24 covers the back face part of the insulator 23 as described above, electrical signals can be transmitted with the further suppressed influence of electromagnetic waves.

With the configuration that the back shell 24 is held by the insulator 23, the back shell 24 can be disposed inside the peripheral shell 22 as viewed in the fitting direction for fitting with a counter-connector, which realizes the miniaturized connector 21.

Embodiment 3

Figure 15:
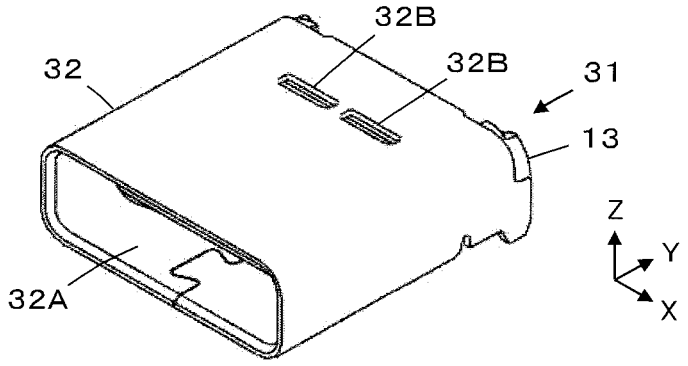
FIG. 15 is a perspective view showing a connector according to Embodiment 3.

FIG. 15 illustrates the structure of a connector 31 according to Embodiment 3.

Figure 16:
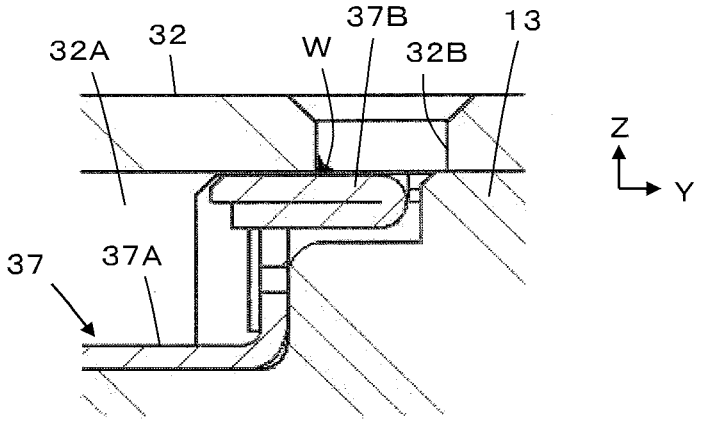
FIG. 16 is a cross-sectional partial view showing a window portion of a peripheral shell and a shell-connecting portion of a ground plate in the connector of Embodiment 3.
Figure 16:
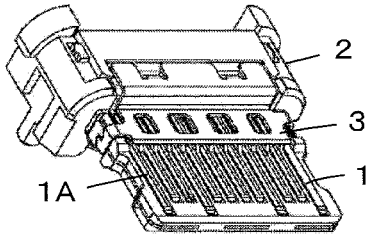
Figure 17:
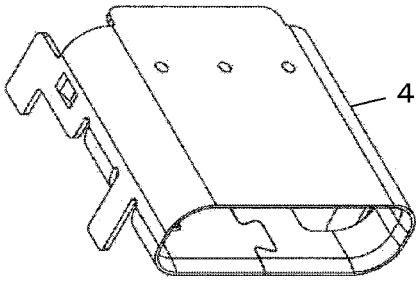
FIG. 17 PRIOR ART
FIG. 17 is an exploded perspective view showing a conventional connector.

In the connector 31, in place of the peripheral shell 12 used in the connector 11 of Embodiment 1, a peripheral shell 32 provided with a counter-connector accommodation portion 32A and two window portions 32B covers the outer periphery of the insulator 13, and a first ground plate 37 as illustrated in FIG. 16 is used in place of the first ground plate 17 of the connector 11. The other constituent components of the connector 31 than the above are the same as those of the connector 11 of Embodiment 1.

The two window portions 32B of the peripheral shell 32 are aligned in the X direction and each penetrate from an outside surface to an inside surface of the peripheral shell 32.

The first ground plate 37 is formed of a metal plate having a smaller thickness than that of the peripheral shell 12 and includes a ground plate body 37A in a flat plate shape exposed to a counter-connector accommodation portion 32A, and a shell-connecting portion 37B bending from an end in the +Y direction of the ground plate body 37A to the +Z direction and connected to an inside surface of the peripheral shell 32.

The shell-connecting portion 37B is formed of a metal plate that constitutes the first ground plate 37 and is folded in two layers. More specifically, the shell-connecting portion 37B is twice as thick as the ground plate body 37A, or is more than twice as thick as the ground plate body 37A if a gap is provided between the layers formed by the metal plate that is folded in two layers.

The shell-connecting portion 37B of the first ground plate 37 is in contact with the window portions 32B from the inside of the peripheral shell 32, and a part of the shell-connecting portion 37B is exposed to the outside of the peripheral shell 32 through the window portions 32B.

In each of the window portions 32B, a welding portion W is formed between an edge of the window portion 32B and the shell-connecting portion 37B. That is, the edge of the window portion 32B and the shell-connecting portion 37B are welded to each other, whereby the peripheral shell 32 is electrically connected to the first ground plate 37.

The welding portion W can be formed by, for example, emission of a laser beam to a contacting portion between an edge of each of the window portions 32B of the peripheral shell 32 and the shell-connecting portion 37B of the first ground plate 37 through the window portion 32B for laser-welding the edge of the window portion 32B and the shell-connecting portion 37B.

In this process, since the contacting portion between the edge of the window portion 32B and the shell-connecting portion 37B is irradiated with a laser beam through the window portion 32B formed in the peripheral shell 32, there is no need for melting and piercing the peripheral shell 32, whereby the welding can be carried out with a small laser power.

In addition, since the shell-connecting portion 37B of the first ground plate 37 is formed of a metal plate that constitutes the first ground plate 37 and is folded in two layers, even if one layer on the window portion 32B side of the two layers of the metal plate forming the shell-connecting portion 37B is melted and pierced through as a result of irradiation with a laser beam for welding the edge of the window portion 32B and the shell-connecting portion 37B, the other layer of the two layers of the metal plate exists therebelow and protects the connector components such as the insulator 13, the first contacts 14 and the second contacts 15 disposed farther from the shell-connecting portion 37B inside the connector 31 from being damaged by a laser beam.

The welding portion W is formed in this manner in each of the two window portions 32B, and the peripheral shell 32 is electrically connected to the first ground plate 37.

Meanwhile, a plurality of welding portions W may be formed in each of the window portions 32B to connect the peripheral shell 32 to the first ground plate 37.

Moreover, the shell-connecting portion 37B of the first ground plate 37 is not limited to what is formed of a metal plate that constitutes the first ground plate 37 and is folded in two layers but may be formed of a metal plate that is folded in three or more layers so as to have an increased thickness, in case where the connector 31 has thereinside a sufficient space to accommodate it.

The configuration of the first ground plate 37 may be applied not only to the first ground plate 37 that faces the first contacts 14 but also to the second ground plate that is disposed so as to face the second contacts 15. More specifically, while FIG. 15 illustrates the window portions 32B formed on the +Z direction side of the peripheral shell 32, the window portions 32B penetrating through the peripheral shell 32 may be also formed on the −Z direction side of the peripheral shell 32, the shell-connecting portion of the second ground plate may be formed of a metal plate that constitutes the second ground plate and is folded in multiple layers, and a laser beam may be emitted through each of the window portions 32B on the −Z direction side of the peripheral shell 32 to form the welding portion W between an edge of this window portion 32B and the shell-connecting portion of the second ground plate, for example, whereby the peripheral shell 32 can be electrically connected to the second ground plate.

What is claimed is:

1. A connector comprising:

a plurality of contacts arranged in a contact-arrangement plane and including a source contact and a signal contact, each of the plurality of contacts having a contact portion that comes into contact with a contact of a counter-connector;

a ground plate made of metal disposed in parallel with the contact-arrangement plane;

an insulator that holds the plurality of contacts and the ground plate; and a shell that covers an outer periphery of the insulator and is made of metal, wherein the ground plate is disposed so as to face the plurality of contacts through a portion of the insulator with the contact portion of each of the plurality of contacts being exposed, and has a cutout formed at an end of the ground plate adjacent to the contact portion of the source contact, and wherein the insulator has a projection that fills the cutout of the ground plate.

2. The connector according to claim 1, wherein each of the plurality of contacts includes the contact portion that is formed at one end thereof and is exposed out from the insulator, a board-connecting portion that is formed at another end thereof and is exposed out from the insulator to be connected to a board, and an insulator fixing portion that connects between the contact portion and the board-connecting portion and is embedded in the insulator, and wherein the ground plate faces the insulator fixing portion of each of the plurality of contacts.

3. The connector according to claim 2, wherein the ground plate includes a ground plate body facing the insulator fixing portion of each of the plurality of contacts and a shell-connecting portion joined to the ground plate body and connected to the shell, and the cutout is formed in the ground plate body.

4. The connector according to claim 3, wherein the ground plate is made of a metal plate having a smaller thickness than that of the shell, and the shell-connecting portion is formed of the metal plate that is folded in layers, wherein the shell has a window portion disposed so as to face the ground plate, and wherein the shell-connecting portion contacts the window portion from inside of the shell and is welded to an edge of the window portion in an interior of the window portion, thereby being connected to the shell.

5. The connector according to claim 1, further comprising a mid-plate that is made of metal and is disposed in parallel with the contact-arrangement plane so as to face the plurality of contacts on an opposite side from the ground plate, wherein the mid-plate has at least one opening portion at a location facing the source contact.

6. The connector according to claim 5, wherein the plurality of contacts are arranged on each of a pair of the contact-arrangement planes respectively formed on both sides of the mid-plate.

7. The connector according to claim 1, wherein the shell includes: a peripheral shell that covers the outer periphery of the insulator except a front face part and a back face part of the insulator in a fitting direction of the connector with the counter-connector; and a back shell that covers the back face part of the insulator in the fitting direction of the connector with the counter-connector and has a held portion to be held by the insulator, and wherein the insulator has a back shell holder that holds the held portion of the back shell, thereby holding the back shell.

8. The connector according to claim 7, wherein the peripheral shell has a leg portion that is inserted into a through-hole formed in a board and that is fixed by soldering to the through-hole, wherein the back shell has a butt-joint terminal that is disposed adjacent to the leg portion of the peripheral shell and mounted and fixed on the board, and wherein the butt-joint terminal is fixed to a pad at the through-hole on a front surface side of the board with a solder fillet formed when the leg portion of the peripheral shell is soldered to the through-hole in the board.

9. The connector according to claim 7, wherein the back shell is disposed inside the peripheral shell when viewed in the fitting direction of the connector with the counter-connector.

* * * * *